US006419100B1

(12) United States Patent
Menz et al.

(10) Patent No.: US 6,419,100 B1
(45) Date of Patent: Jul. 16, 2002

(54) DISPLAY UNIT WITH SNAP-IN BOTTOM COVER

(75) Inventors: Albert Menz, New York; Bruce Gommermann, Northport, both of NY (US)

(73) Assignee: Display Technologies, LLC, College Point, NY (US)

( * ) Notice: Subject to any disclaimer, the term of this patent is extended or adjusted under 35 U.S.C. 154(b) by 0 days.

(21) Appl. No.: 09/863,627

(22) Filed: May 23, 2001

(51) Int. Cl.[7] ..... A47F 5/00
(52) U.S. Cl. ..... 211/207; 211/190; 211/187
(58) Field of Search ..... 211/207, 208, 211/189, 190, 191, 182, 187

(56) References Cited

U.S. PATENT DOCUMENTS 4,119,207 A * 10/1978 Fuller et al. ..... 211/189 X
4,344,367 A * 8/1982 Merl ..... 211/187 X
4,611,866 A * 9/1986 Everett ..... 211/190 X
4,633,788 A * 1/1987 Robertson ..... 211/189 X
4,767,014 A * 8/1988 Vail et al. ..... 211/207
4,981,226 A * 1/1991 Shallenberg et al. ..... 211/189
5,014,862 A * 5/1991 Bustos ..... 211/207 X
5,272,991 A * 12/1993 Canigan ..... 211/193 X
6,003,697 A * 12/1999 Ferchat et al. ..... 211/189
6,193,085 B1 * 2/2001 Nook et al. ..... 211/187

* cited by examiner

*Primary Examiner*—Robert W. Gibson, Jr.
(74) *Attorney, Agent, or Firm*—Amster, Rothstein & Ebenstein

(57) ABSTRACT

A display unit has at least two laterally spaced apart pairs of telescoping uprights, each pair including an inner upright and an outer upright covering at least two adjacent sides of the inner upright, and for each pair a cover configured and dimensioned to be removably mounted on a bottom portion of the inner upright exposed when the pair is in an extended orientation such that the cover conceals the exposed bottom portion of the inner upright.

11 Claims, 5 Drawing Sheets

FIG. 4
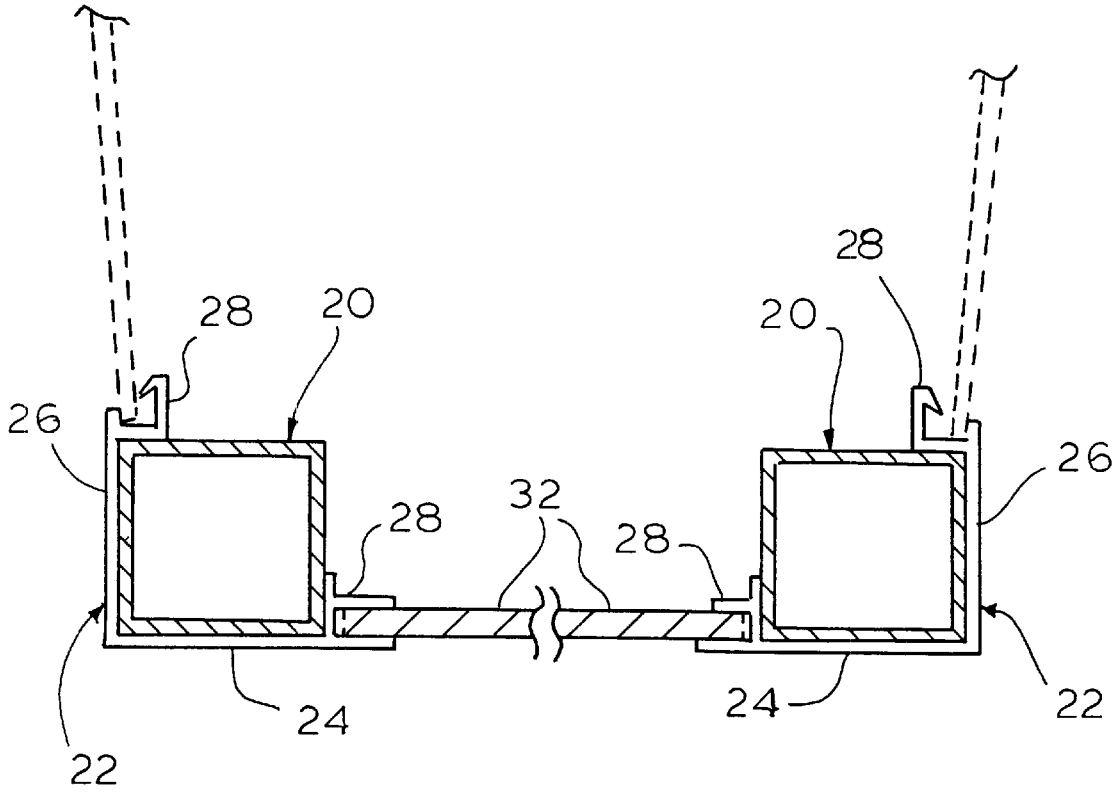
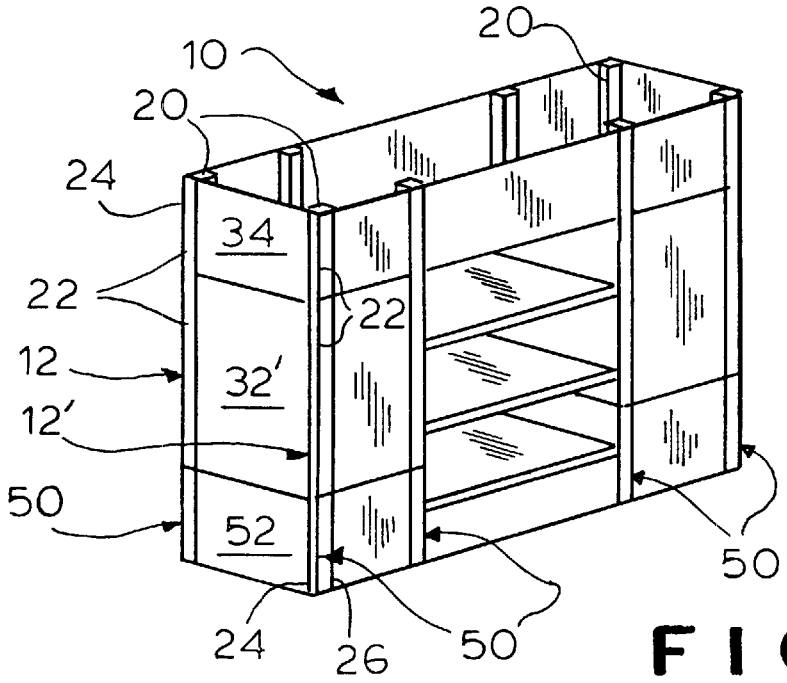
FIG. 5

DISPLAY UNIT WITH SNAP-IN BOTTOM COVER

BACKGROUND OF THE INVENTION

The present invention relates to a stand-alone display unit, and more particularly to a stand-alone display unit of variable height.

It is known to provide a stand-alone display unit for use as an end piece (often called an "end cap") at the end of a store aisle for displaying products. Such display units may be of extreme modularity in that they can be varied in height, in width, in depth, and even in the angular tilt of the display shelf, in order to meet the available space in a particular aisle of a particular store and provide the degree of tilt required to gravity feed particular products.

In order to achieve vertical (height) adjustability, the display unit typically comprises at least two laterally spaced apart pairs of telescoping members, each pair being deployed as a corner or intermediate upright for the display unit. Each pair of telescoping members typically includes an inner member and an outer member covering at least two adjacent sides of the inner member for a corner upright and typically three adjacent sides of the inner member for an intermediate upright. The inner telescopic member is formed of metal to provide strength to the upright, while the outer telescopic members is formed of a plastic which provides less strength than the metal of the inner telescopic member, but is more attractive and additionally provides support for a vertical edge of a graphics panel extending between two adjacent outer telescopic members.

The telescopic members of each pair are typically of substantially equal height, with the outer member being moveable (sizeable) between retracted and extended orientations relative to the stationary inner member. In the retracted or telescoped orientation, both members of each pair have the tops and bottoms thereof horizontally aligned so that the outer member at least partially conceals the inner member for the entire length of the inner member. In the extended or untelescoped orientation, the outer member has the top and bottom thereof higher than the corresponding top and bottom of the inner member so that a bottom portion of the inner member is exposed. Typically, the members are placed in the extended orientation when it is desired to provide a display unit with a top graphics panel which is disposed either entirely or at least partially above the tops of the inner telescopic members for better viewing by passing customers.

The adjustable height display units of the prior art have not proven to be entirely satisfactory. When the telescopic members are in the extended orientation (i.e., the components are partially untelescoped), the bottom portion of the less attractive inner component at the bottom of the pair is exposed to view by customers. Further, the frictional traction between the inner and outer members may not be strong enough to prevent accidental downward sliding of the outer member over time. Similarly, as the graphics panels are often only loosely held between the outer members, they tend to slide downwardly over time if they are not supported from underneath by other graphics panels (and eventually the floor). Finally, because the bottom portions of the inner members exposed when the outer members are moved upwardly into the extended orientation are not equipped for the mounting of a graphics panel therebetween, potential advertising space between the exposed bottom portions of the inner member are not put to productive advertising use. Thus, the very purpose for which the telescopic members were placed in the second orientation—that is, to increase the graphics panel space available for use—may become frustrated.

Accordingly, it is an object of the present invention to provide a display unit which includes means for concealing the exposed bottom portions of the inner telescopic members when the telescopic members are in the extended orientation.

Another object is to provide such a display unit wherein in one embodiment the outer member in the extended orientation is blocked from accidental downward motion.

Yet another object is to provide such a display unit wherein in one embodiment it is capable of displaying a bottom graphics panel when the telescopic members are in the extended orientation.

A further object is to provide such a display unit wherein in one embodiment the bottom graphics panel can provide support for successive graphics panels thereabove.

It is also an object to provide such a display unit which is simple and economical to manufacture, use and maintain.

SUMMARY OF THE INVENTION

It is has now been found that the above and related objects of the present invention are obtained in a display unit comprising at least two laterally spaced apart pairs of telescoping members and at least two cover members. Each pair of telescoping members includes an inner member and an outer member covering at least two adjacent sides of the inner members, the telescoping members of each pair being of substantially equal height. The outer member is movable between first and second orientations relative to the inner member. In the first orientation both members of each pair have the tops and bottoms thereof horizontally aligned so that the outer member at least partially conceals the inner member for the entire length of the inner member; and in the second orientation-the outer member has the top and bottom thereof higher than the corresponding top and bottom of the inner member so that a bottom portion of the inner member is exposed. For each pair there is a cover member configured and dimensioned to be removably mounted on the bottom portion of the inner member exposed when the pair is in the second orientation such that the cover member at least partially conceals the exposed bottom portion of the inner member.

In one preferred embodiment, the outer member is formed of plastic, and the inner member is formed of metal. The inner member preferably has a rectangular cross section. The cover member, when mounted on the bottom portion of the inner member of one pair, supports the outer member of the one pair such that the one pair is maintained in the second orientation.

In another preferred embodiment, the outer member of each pair includes means for receiving and supporting, cooperatively with the outer member of another pair, a graphics panel disposed between the outer members. When the one pair is in the second orientation, a top portion of the outer member extending above a top portion of the inner member, cooperatively with a top portion of another the outer member, supports a top graphics panel disposed between the outer member top portions. The cover member mounted on each bottom portion includes means for receiving and supporting, cooperatively with the cover member mounted on another bottom portion, a bottom graphics panel disposed between the cover members.

Preferably the cover member is configured and dimensioned to be removably mounted on the exposed bottom portion of the inner member by a snap-fit.

BRIEF DESCRIPTION OF THE DRAWING

The above and related objects, features and advantages of the present invention will be more fully understood by reference to the following detailed description of the presently preferred, albeit illustrative, embodiments of the present invention when taken in conjunction with the accompanying drawing wherein:

FIG. 4 is a sectional view taken along the line 4—4 of FIG. 1;

FIG. 5 is an isometric view of the display unit;

DETAILED DESCRIPTION OF THE PREFERRED EMBODIMENTS

Figure 1:
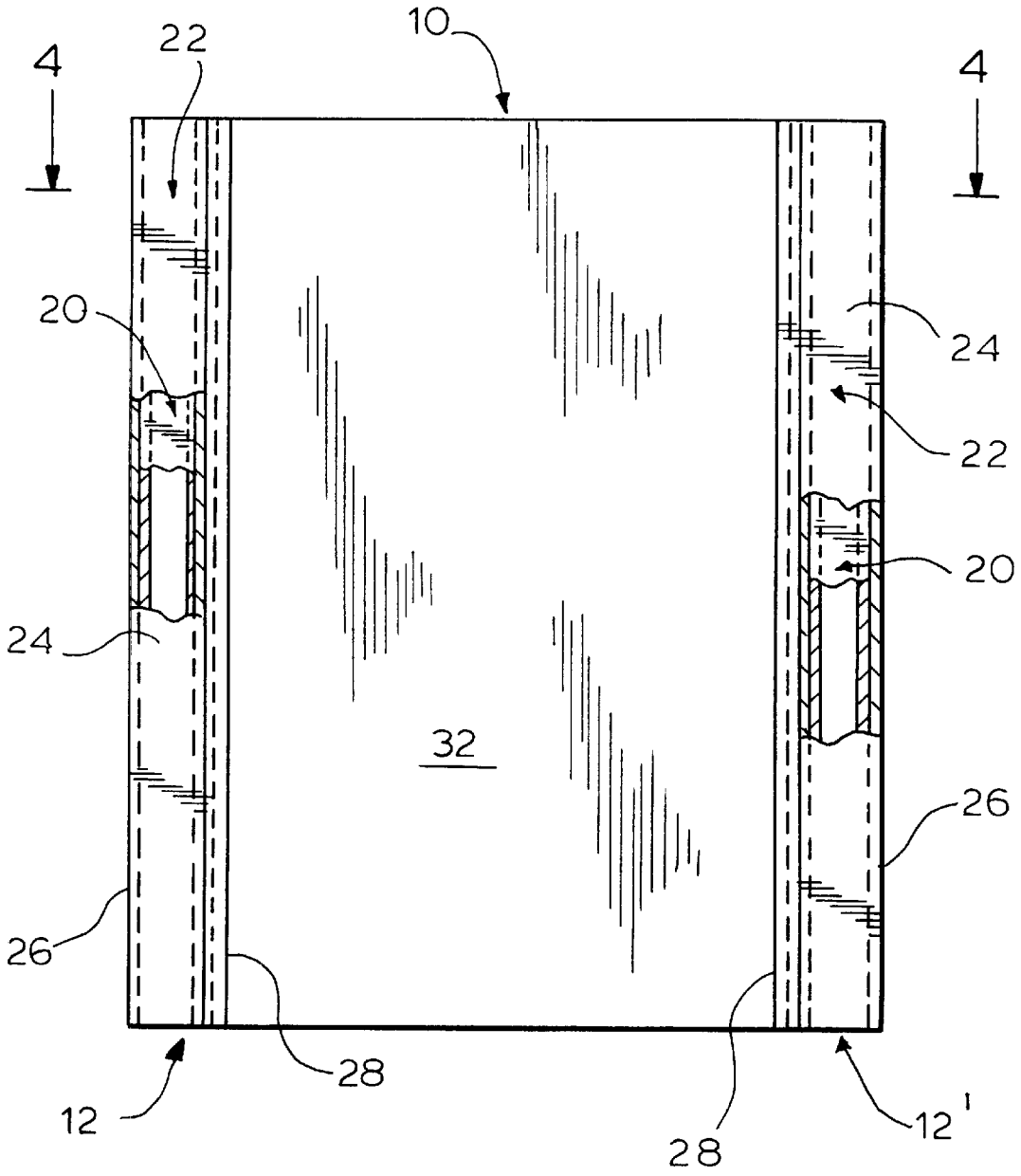
FIG. 1 is a front elevational view of a display unit according to the present invention with the telescopic members in the retracted first orientation.
Figure 2:
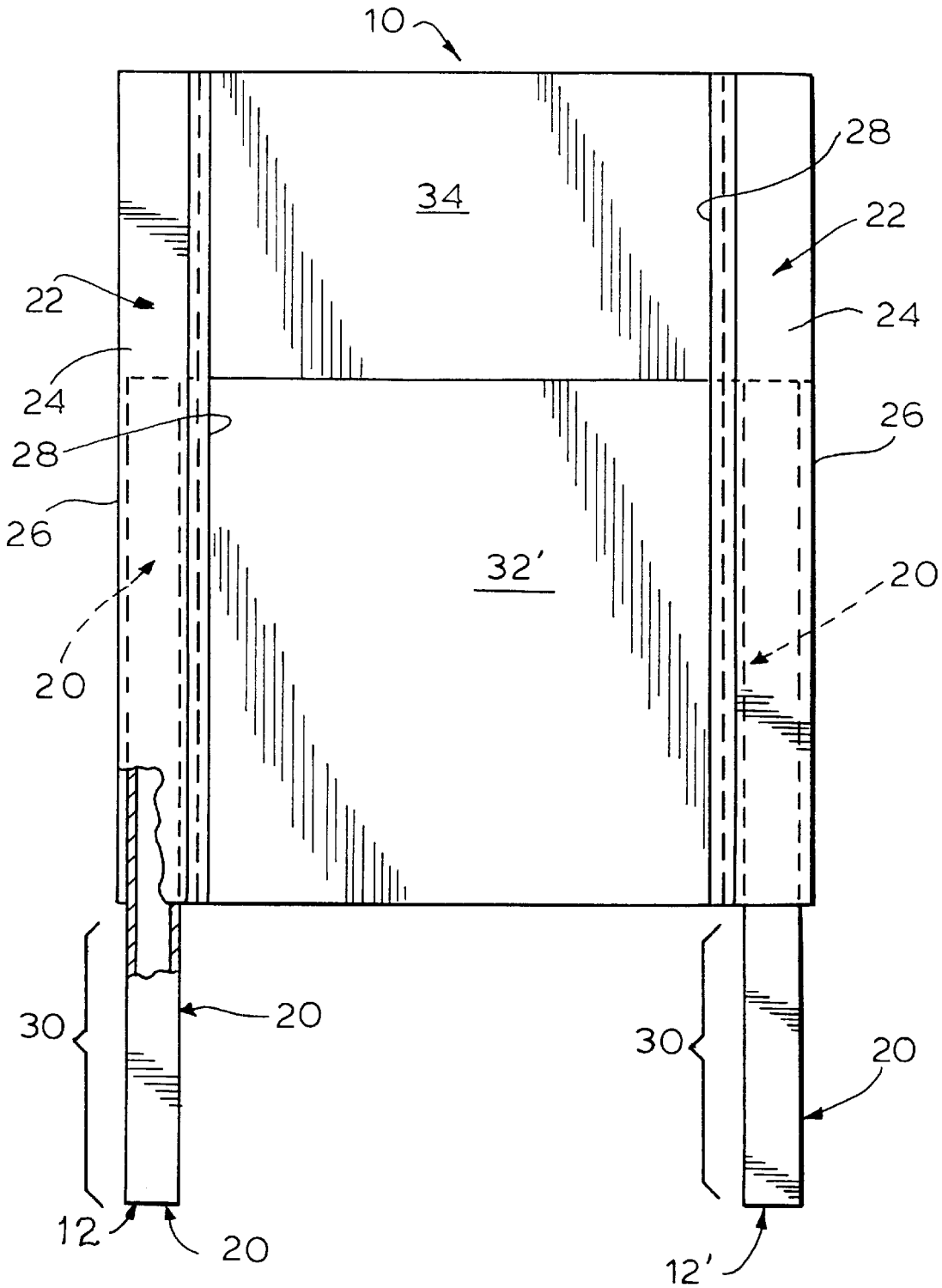
FIG. 2 is a view similar to FIG. 1, but with the telescopic members in the extended second orientation.

Referring now to FIGS. 1 and 2, therein illustrated is a display unit according to the present invention, generally designated by the reference numeral 10. In its conventional aspects the display unit 10 comprises at least two laterally spaced apart pairs 12, 12' of telescoping members. Each pair 12, 12' includes an inner telescoping member 20 and an outer telescoping member 22. In each pair 12, 12', the telescoping members 20, 22 are of substantially equal length or height, although the telescoping members of one pair may be of a different height then the telescoping members of another pair. The inner telescoping member 20 is typically formed of metal or a like material of sufficient strength to act as the structural member of an upright for a display unit. The inner member preferably has a rectangular cross section, although other cross sections may be used. The outer member 22 is typically formed of plastic or a-like decorative material and preferably covers and conceals at least two adjacent sides of the inner member 20 for the full length of the inner member 20 when the pair 12, 12' constitutes a corner upright, and preferably at least three adjacent sides of the inner member 20 when the pair constitutes an intermediate upright (that is, an upright disposed between two comer uprights, as indicated in FIG. 5). In those instances where the inner member 20 is not of rectangular cross section, the inner surface of the outer member 22 preferably defined a corresponding mating configuration which at least partially conceals from view the entire length of the inner member 20.

Typically the outer member 22 snugly grips the inner member 20 but is slidably moveable between first and second orientations relative to the inner member 20. In the first or retracted (telescoped) orientation illustrated in FIG. 1, both telescopic members 20, 22 of each pair have the tops and bottoms thereof horizontally aligned so that the outer member 22 at least partially conceals the inner member 20 for the entire length of the inner member 20. In a corner upright, the outer member preferably conceals two adjacent sides of the inner member 20, while in an intermediate upright, the outer member 22 preferably conceals three adjacent sides of the inner member 20. In both instances, the sides of the inner member 20 which are not concealed by the outer member 22 are not readily viewable by passing customers and thus of little concern. In the second or extended (untelescoped) orientation illustrated in FIG. 2, the outer member 22 typically has the top and bottom thereof higher than the corresponding top and bottom of the inner member 20 so that a bottom portion or bottom length 30 of the inner member 20 is exposed to view.

Referring now to FIG. 1, therein illustrated is a main graphics panel 32 extending between and supported by two adjacent outer members 22 in the retracted orientation. Referring now to FIG. 2, therein illustrated as well is a top graphics panel 34 extending between the top portions 36 of the outer members 22 disposed above the tops of the inner members 20 in the extended orientation; Thus, the outer member 22 of one pair includes sides with longitudinal free edges 24, 26 having means 28 for receiving and supporting, cooperatively with the outer member 22 of another pair 12', a main graphics panel 32 disposed between the outer members 22. Further, when one pair 12 is in the extended second orientation, a top portion 36 of the outer member 22 thereof extending above a top portion of the inner member 20 thereof, cooperatively with a top portion 36 of the outer member 22 of another pair 12' in the extended second orientation, supports a top graphics panel 34 disposed between the outer member top portions 36.

Referring now to FIG. 4 in particular, the receiving and supporting means 28 may simply be a recess or groove adapted to receive therein or allow passage therethrough of a longitudinal side edge of a graphics panel. Such recess or groove may be either loose, to facilitate passage of the graphics panel edge therethrough, or snug, to frictionally retain the graphics panel edge placed therein against accidental sliding relative thereto. Indeed, where it is expected that the graphics panel will be outwardly bowed between the two outer members 22, the receiving and supporting means 28 may be angled or even feathered to facilitate retention of the bowed graphics panel edge therein. The receiving and supporting means 28 on both longitudinal free edges 24, 26 may be of the same type and configuration or each free end may be of a different type and configuration—for example, so that one edge can be used to support part of a planar graphics panel and the other edge can be used to support part of a bowed graphics panel. As illustrated, the edge 24, 26 are of different types.

Of course, if the main graphics panel 32 extended the full length of the outer members 22, as illustrated in FIG. 1, then, when the telescopic members are in the second orientation and a top graphics panel 34 is deployed between the outer member top portions 36, the main graphics panel 32 is typically replaced by a shorter main graphics panel 32' which occupies only the space between the outer members 22 not occupied by the top graphics panel 34, as illustrated in FIG. 2. However, if desired, the main graphics panel 32 may simply be raised with the outer members 22 when the inner and outer members are moved into the extended second orientation.

The features of the display unit 10 described hereinabove are conventional and well-known to those skilled in the art. Accordingly, it is not deemed necessary to provide further details of their construction and use herein.

As earlier noted, the arrangement illustrated in FIG. 2 (whether there are separate top and modified main graphics panels 34, 32' or simply an elevated main graphics panel 32) is not entirely satisfactory. In the extended second orientation, the inner member bottom portions 30 are on view, the maintenance of the disposition of the telescopic members 20, 22 in the extended second orientation depends on a less than totally reliable friction fit between the two members, the maintenance of the disposition of the graphic panel(s) 32 or 32' and 34 is even more tenuous, and the space between the inner member bottom portions 30 is unutilized or underutilized inasmuch as there is no graphics panel disposed therebetween.

Figure 3:
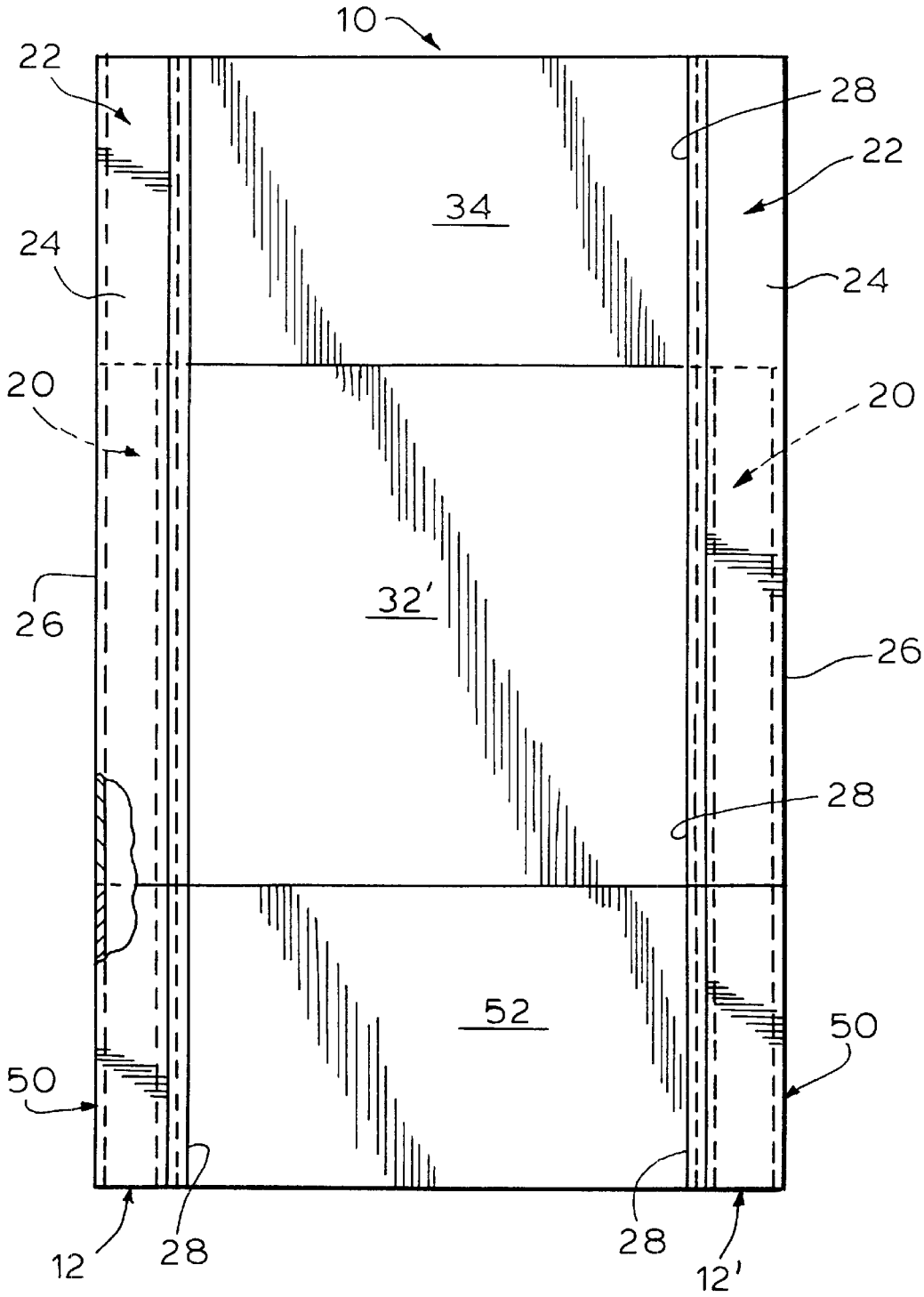
FIG. 3 is a view similar to FIG. 2, but with cover members covering the exposed bottom portions of the inner telescopic members and a bottom graphics display panel supported between the cover members.

Referring now to FIG. 3, in order to overcome the above-identified disadvantages the present invention provides, for each pair 12, 12' of telescoping members 20, 22, a cover member generally designated 50. The cover member 50 is preferably identical in composition, configuration and dimensions to the outer member 22 except for length. The length of the cover member 50 is less than that of the outer member 22 and preferably equal in length (height) to the outer member portion 36, the top graphics panel 34 or the portion of the main graphics panel 32 which will extend above the top of the inner members 20, or the height of the inner member bottom portion 30 exposed by the movement of the telescopic members from the retracted first orientation (FIG. 1) to the extended second orientation (FIG. 2) (all of these being equivalent).

Thus, when the cover members 50 are removably mounted on the inner member bottom portions 30 exposed when the pairs 12, 12' are in the extended second orientation, the cover members 50 at least partially conceal the exposed inner member bottom portions 30. Additionally, the cover members 50 supports the outer members 22 such that the pairs are maintained in the extended second orientation. In other words, each cover member 50 blocks accidental downward sliding movement of the outer portion 22 from its extended second orientation back to its retracted first orientation. Further, the cover members 50 include means for receiving and supporting, cooperatively with an adjacent cover member 50, a bottom graphics panel 52 disposed between the cover members 50. Thus, in the second orientation, the display 10 is capable of supporting not only a modified main graphics panel 32', but also a top graphics panel 34 and a bottom graphics panel 52. The presence of the bottom graphics panel 52 not only makes productive use of the space between the inner member bottom portions 30, but also provides support for the graphic panel 32 or 32' immediately thereabove to preclude accidental downward sliding thereof.

While the outer telescopic member 22 may be easily slid over the inner telescopic member 20 before the pair 12, 12' of members are disposed in the upright orientation, this is typically not an option for the cover member 50 which is typically added to the pair 12, 12' after the pair is in the upright orientation and a part of a final structure. Accordingly, the cover member 50 is preferably configured and dimensioned to be removably mounted on the exposed inner member bottom portion 30 by a snap-fit. Accordingly, the plastic of the cover member 50 must have some resilient give therein or the thickness of at least one side thereof (or the connection between two adjacent sides thereof) must be dimensioned to provide for the slight resilient give required to enable the cover member 50 to be snapped on to an inner member bottom portion 30.

Figure 6:
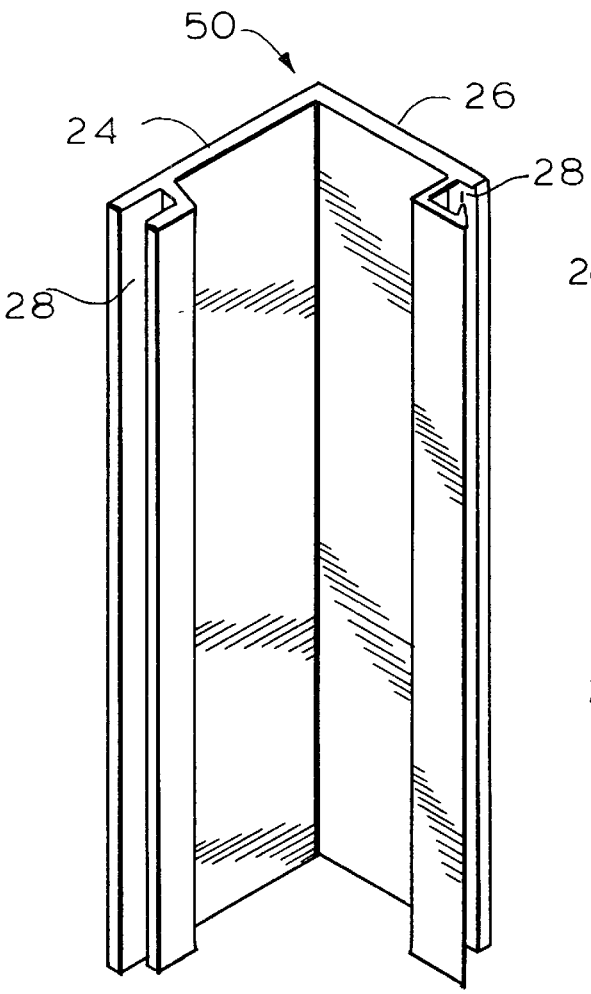
FIG. 6 is a rear isometric view of the cover member for use on a corner upright.

Referring now to FIG. 6 in particular, therein illustrated is the cover member 50 suitable for use on a corner upright. The cover member 50 is of generally L-shaped configuration and defines two sides 24, 26, each side 24, 26 preferably having a separate receiving and supporting means 28.

Figure 7:
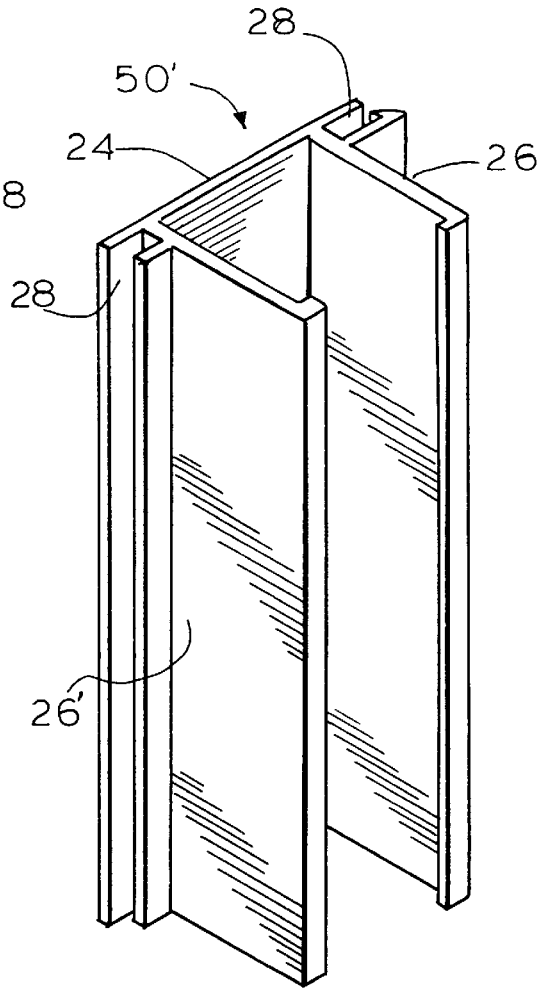
FIG. 7 is a rear isometric view of the cover member for use on an intermediate upright.

Referring now to FIG. 7 in particular, therein illustrated is a cover member 50' suitable for use on an intermediate upright. The cover member 50' is of generally U-shape configuration and defines three sides 24, 26, 26' (the base or bight being element 24 and the two legs being elements 26, 26'). Whereas the cover member 50 conceals at least two adjacent sides of the inner member 20, the cover member 50' conceals at least three adjacent sides of the inner member 20. Further, the receiving and supporting means 28 are at the edges of the base 24 of the U-shaped cover member 50' rather than at the free ends of the legs. The legs 26, 26' are forcibly deformable away from one another sufficiently to enable the cover member 50' to be snapped onto the inner member 20 of an intermediate upright.

Each cover member 50, 50' is invertable so that, when the two receiving and supporting means 28 thereon differ, the appropriate means 28 may be positioned and brought into play for supporting particular graphics panels.

To summarize, the present invention provides a display unit which includes means for concealing the exposed bottom portions of the inner telescopic members when the telescopic members are in the extended orientation, such means blocking the outer members from accidental downward motion and further being capable of receiving and supporting a bottom graphics panel. The bottom graphics panel in turn can provide support for successive graphics panels thereabove. The unit is simple and economical to manufacture, use and maintain.

Now that the preferred embodiments of the present invention have been shown and described in detail, various modifications and improvements thereon will become readily apparent to those skilled in the art. Accordingly, the spirit and scope of the present invention is to be construed broadly and limited only by the appended claims, and not by the foregoing specification.

We claim:

1. A display unit comprising:

(A) at least two laterally spaced apart pairs of telescoping members, each said pair of telescoping members including an inner member and an outer member covering at least two adjacent sides of said inner member; said telescoping members of each pair being of substantially equal height, said outer member being movable between first and second orientations relative to said inner member, in said first orientation both said members of each pair having the tops and bottoms thereof horizontally aligned so that said outer member at least partially conceals said inner member for the entire length of said inner member, and in said second orientation said outer member having the top and bottom thereof higher than the corresponding top and bottom of said inner member so that a bottom portion of said inner member is exposed; and (B) for each said pair of telescoping members, a cover member configured and dimensioned to be removably mounted on said inner member bottom portion exposed when said pair is in said second orientation such that said cover member at least partially conceals said exposed inner member bottom portion.

2. The unit of claim 1 wherein said outer member is formed of plastic, and said inner member is formed of metal.

3. The unit of claim 1 wherein said inner member has a rectangular cross section.

4. The unit of claim 1 wherein said cover member, when mounted on said inner member bottom portion of one said pair, supports said outer member of said one pair such that said one pair is maintained in said second orientation.

5. The unit of claim 1 wherein said outer member of one said pair includes means for receiving and supporting, cooperatively with said outer member of another said pair, a graphics panel disposed between said outer members.

6. The unit of claim 1 wherein said cover member mounted on one said inner member bottom portion includes means for receiving and supporting, cooperatively with said cover member mounted on another said inner member bottom portion, a bottom graphics panel disposed between said cover members.

7. The unit of claim 1 wherein, when one said pair is in said second orientation, a top portion of said outer member extending above a top portion of said inner member, cooperatively with a top portion of another said outer member, supports a top graphics panel disposed between said outer member top portions.

8. The unit of claim 1 wherein said cover member is configured and dimensioned to be removably mounted on said exposed inner member bottom portion by a snap-fit.

9. A display unit comprising:

(A) at least two laterally spaced apart pairs of telescoping members, each said pair of telescoping members including an inner member of steel having a rectangular cross section and an outer member of plastic covering at least two adjacent sides of said inner member, said telescoping members of each pair being of substantially equal height; said outer member being movable between first and second orientations relative to said inner member, in said first orientation both said members having the tops and bottoms thereof horizontally aligned so that said outer member at least partially conceals said inner member for the entire length of said inner member, and in said second orientation said outer member having the top and bottom thereof higher than the corresponding top and bottom of said inner member so that a bottom portion of said inner member is exposed; and (B) for each said pair of telescoping members, a cover member configured and dimensioned to be removably mounted by a snap-fit on said inner member bottom portion exposed when said pair is in said second orientation such that said cover member conceals said exposed inner member bottom portion and supports said outer member of said pair such that said pair is maintained in said second orientation.

10. The unit of claim 9 wherein said outer member of one said pair includes means for receiving and supporting, cooperatively with said outer member of another said pair, a graphics panel disposed between said outer members; and said cover member mounted on one said inner member bottom portion includes means for receiving and supporting, cooperatively with said cover member mounted on another said inner member bottom portion, a bottom graphics panel disposed between said cover members.

11. The unit of claim 10 wherein, when one said pair is in said second orientation, a top portion of said outer member extending above a top portion of said inner member, cooperatively with a top portion of another said outer member, supports a top graphics panel disposed between said outer member top portions.

* * * * *